US008734193B2

(12) United States Patent
Tokuhara et al.

(10) Patent No.: US 8,734,193 B2
(45) Date of Patent: May 27, 2014

(54) CONNECTOR

(75) Inventors: Yayoi Tokuhara, Shinagawa (JP); Koichi Kiryu, Shimotakai (JP)

(73) Assignee: Fujitsu Component Limited, Tokyo (JP)

( * ) Notice: Subject to any disclaimer, the term of this patent is extended or adjusted under 35 U.S.C. 154(b) by 148 days.

(21) Appl. No.: 13/414,135

(22) Filed: Mar. 7, 2012

(65) Prior Publication Data

US 2012/0231665 A1 Sep. 13, 2012

(30) Foreign Application Priority Data

Mar. 7, 2011 (JP) ..... 2011-049467

(51) Int. Cl.
*H01R 13/24* (2006.01)

(52) U.S. Cl.
USPC ..... 439/824; 439/700

(58) Field of Classification Search
CPC ..... H01R 13/2428
USPC ..... 439/700, 824, 862
See application file for complete search history.

(56) References Cited

U.S. PATENT DOCUMENTS

| | | | | |
|---|---|---|---|---|
| 4,199,209 | A * | 4/1980 | Cherian et al. | 439/591 |
| 4,553,192 | A * | 11/1985 | Babuka et al. | 361/743 |
| 6,935,901 | B2 * | 8/2005 | Simpson et al. | 439/700 |
| 7,527,538 | B2 * | 5/2009 | Mizutani | 440/61 S |
| 7,775,804 | B2 * | 8/2010 | Neidich et al. | 439/66 |

FOREIGN PATENT DOCUMENTS

| | | |
|---|---|---|
| JP | 2008-276987 | 11/2008 |
| JP | 2010-219014 | 9/2010 |

* cited by examiner

*Primary Examiner* — Xuong Chung Trans
(74) *Attorney, Agent, or Firm* — Staas & Halsey LLP

(57) ABSTRACT

A connector including a contact member and a housing. The contact member includes a spring part having a length variable in an axial direction, and a contact part extending from an axial end of the spring part and adapted to be pushed against and electrically connected to a counterpart flat contact. The spring part includes a slanted meandering portion provided with a plurality of major arms spaced from each other in the axial direction and generally slanted with respect to the axial direction. The slanted meandering portion is adapted to be elastically deformed so as to narrow a space between the major arms by a contact pressure applied from the counterpart flat contact to the contact part. The contact part is adapted to be displaced so as to slide on the counterpart flat contact by an elastic deformation of the slanted meandering portion.

6 Claims, 7 Drawing Sheets

CONNECTOR

CROSS-REFERENCE TO RELATED APPLICATIONS

This Application is based upon and claims the benefit of priority from prior Japanese Patent Application No. 2011-049467 filed on Mar. 7, 2011, the entire contents of which are incorporated herein by reference.

BACKGROUND OF THE INVENTION

1. Field of the Invention

The present invention relates to a connector for electrical connection to a counterpart flat contact, and more particularly to a connector including a contact member capable of removing an oxide layer by contacting with the counterpart flat contact under pressure.

2. Description of the Related Art

In an electrical connector, sometimes an oxide layer or other insulating layer is formed over time on the surface of a terminal and/or the surface of a counterpart flat conductor terminal (i.e., a counterpart circuit part), or sometimes dust is deposited on the terminal and/or the counterpart circuit part. The presence of an insulating layer or dust may cause trouble in an electrical connection. To avoid such trouble, an electric connector capable of performing a so-called "wiping" action has been known, in which an insulating layer or dust can be removed by a mutually sliding motion of terminals contacting with each other under a contact pressure during a connecting operation with respect to a counterpart electrical connector or flat conductor.

Japanese Unexamined Patent Publication (Kokai) No. 2008-276987 (JP2008-276987A) describes an electrical connector including a contact member adapted to contact a counterpart contact having a flat plate shape. As depicted in FIGS. 10A-10C, the electrical connector of JP2008-276987A includes a contact member 1 capable of enlarging an effective wiping distance. The contact member 1 is formed by a thin conductive plate, and is assembled into a housing (not shown) which in-turn accommodates a large number of contact members. The contact member 1 is supported on the housing so that a contact part 5 at the end of the contact member 1 can project outward from and be retracted in a slit formed in a top surface of a protective cover (not shown) attached to the housing.

The contact 1 includes a first spring part 3 extending upward from a base part 2, a second spring part 4 extending generally parallel to the first spring part 3, and a contact part 5 formed at the end of the second spring part 4. The second spring part 4 is formed to be able to bend more easily than the first spring part 3.

Due to the above structure, the contact member 1 acts so that, when a flat plate-shaped counterpart contact C pushes the contact part 5 downward, the contact part 5 moves in a direction α (FIG. 10A) due to the deformation of the first spring part 3 and also moves in a direction β (FIG. 10B), opposite to the direction α, due to the deformation of the second spring part 4. Therefore, when the contact member 1 contacts the flat plate-shaped counterpart contact C, the contact part 5 moves back and forth with respect to the counterpart contact C, whereby a relatively long effective wiping distance can be ensured.

Japanese Unexamined Patent Publication (Kokai) No. 2010-219014 (JP2010-219014A) describes an electrical connector in which a wiping amount and a wiping start position are previously determined so as to enable good electrical connection with a counterpart connector. As depicted in FIGS. 11A and 11B, the electrical connector of JP2010-219014A includes a contact member 10 formed from a material having superior electrical conductivity, which is provided with a contact part 10A adapted to be pushed against and electrically connected to an external terminal, a spring part 10D applying a contact pressure to the contact part 10A, and an attachment/fastening part extending from the spring part 10D and adapted to be attached to a connector housing 11. The spring part 10D of the contact member 10 is provided with a plurality of U-shaped spring elements connected in series with each other to form a meandering (or successive S-shape) profile, each U-shaped spring element including a pair of parallel arms 10*d*1 arranged side-by-side with a predetermined space defined therebetween and a curved part 10*d*2 connecting corresponding ends of the parallel arms 10*d*1 to each other, and thereby ensuring a sufficient contact pressure for the contact part 10A.

The contact member 10 also includes, between the contact part 10A and the spring part 10D, a wiping formation part 10B for determining a wiping amount and a wiping start position, which acts to make the contact part 10A move a predetermined distance in a tangential direction of the contact part 10A to slide on a counterpart contact C of an external terminal and thereby perform a predetermined amount of wiping, due to a sliding contact of the wiping formation part 10B with a side wall 12*f* of a contact member receptacle 12 of the connector housing 11, during a time when the contact part 10A is pushed by the external terminal.

In the electrical connector described in JP2008-276987A, the first spring part 3 and the second spring part 4 of the contact member 1 are spaced from each other in a direction substantially perpendicular to a direction of final contact pressure applied from the flat plate-shaped counterpart contact C, so that strength of the spring parts may become insufficient to maintain a contact pressure for ensuring a predetermined electrical connection.

On the other hand, in the electrical connector described in JP2010-219014A, the contact member 10 is provided with a spring part formed from a plurality of U-shaped springs connected in series with each other to form a meandering (or continuous S-shape) profile, so that a sufficient contact pressure can be applied to the contact part 10A from the flat plate-shaped counterpart contact C. However, in the contact member 10, the spring part only performs a spring operation (i.e., an elongate and contract operation), and a wiping operation of the contact part in a direction perpendicular to the direction of the spring operation cannot be obtained by itself. Therefore, it is necessary to provide the wiping formation part 10B for obtaining the wiping operation. The wiping formation part 10B acts to contact the side wall 12*f* formed adjacent to the opening of the contact member receptacle 12 to protrude toward the center of the opening, and thereby enable the contact part to operate a wiping operation.

SUMMARY OF THE INVENTION

It is desired to provide a connector for electrical connection to a counterpart flat contact, which includes a contact member having a simple configuration capable of ensuring a wiping effect, in particular, a wiping distance, and capable of ensuring and easily maintaining a desired contact pressure.

One aspect of the present invention provides a connector comprising a contact member and a housing; the contact member including a spring part having a length variable in an axial direction, and a contact part extending from an axial end of the spring part and adapted to be pushed against and electrically connected to a counterpart flat contact; the spring part including a slanted meandering portion provided with a plurality of major arms spaced from each other in the axial direction and generally slanted with respect to the axial direction; the slanted meandering portion adapted to be elastically deformed so as to narrow a space between the major arms by a contact pressure applied from the counterpart flat contact to the contact part; the contact part adapted to be displaced so as to slide on the counterpart flat contact by an elastic deformation of the slanted meandering portion.

According to one aspect, it is possible to provide a connector for electrical connection to a counterpart flat contact, which includes a contact member having a simple configuration capable of ensuring a wiping effect, in particular, a wiping distance, and capable of ensuring and easily maintaining a desired contact pressure.

In the above configuration, the major arms may be arranged generally parallel to each other when the slanted meandering portion is not elastically deformed; and a space between a first major arm and an adjoining second major arm may be different from a space between the first major arm and an adjoining third major arm opposite to the second major arm.

The slanted meandering portion may be provided with a plurality of alternately arranged curved connections, each curved connection connecting corresponding ends of a pair of adjoining major arms to each other; and a curvature radius of a first curved connection connecting the first major arm to the adjoining second major arm may be different from a curvature radius of a second curved connection connecting the first major arm to the adjoining third major arm.

The contact part may be provided with a straight wiping edge adapted to slide on the counterpart flat contact under the contact pressure.

BRIEF DESCRIPTION OF THE DRAWINGS

The above and other objects, features and advantages of the present invention will become more apparent from the following description of the embodiments in connection with the accompanying drawings, wherein.

DESCRIPTION OF THE EMBODIMENT

Figure 1:
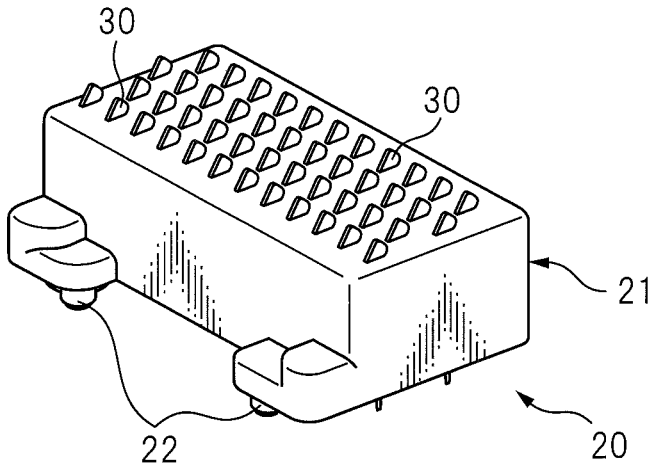
FIG. 1 is a perspective view schematically depicting a connector according to an embodiment of the present invention.

The embodiments of the present invention are described below, in detail, with reference to the accompanying drawings. In the drawings, the same or similar components are denoted by common reference numerals.

Figure 2:
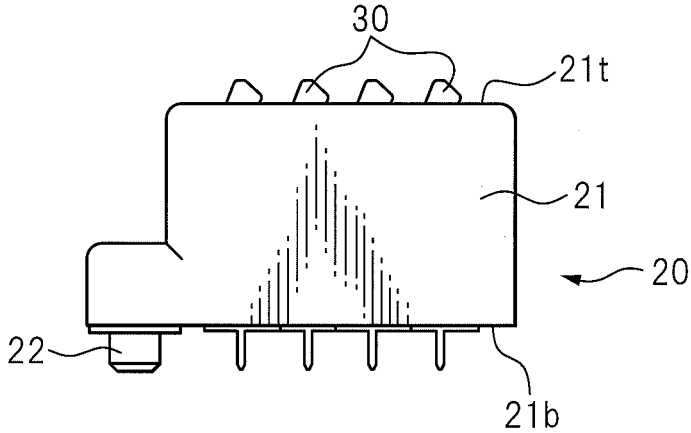
FIG. 2 is a side view schematically depicting the connector of FIG. 1.
Figure 3:
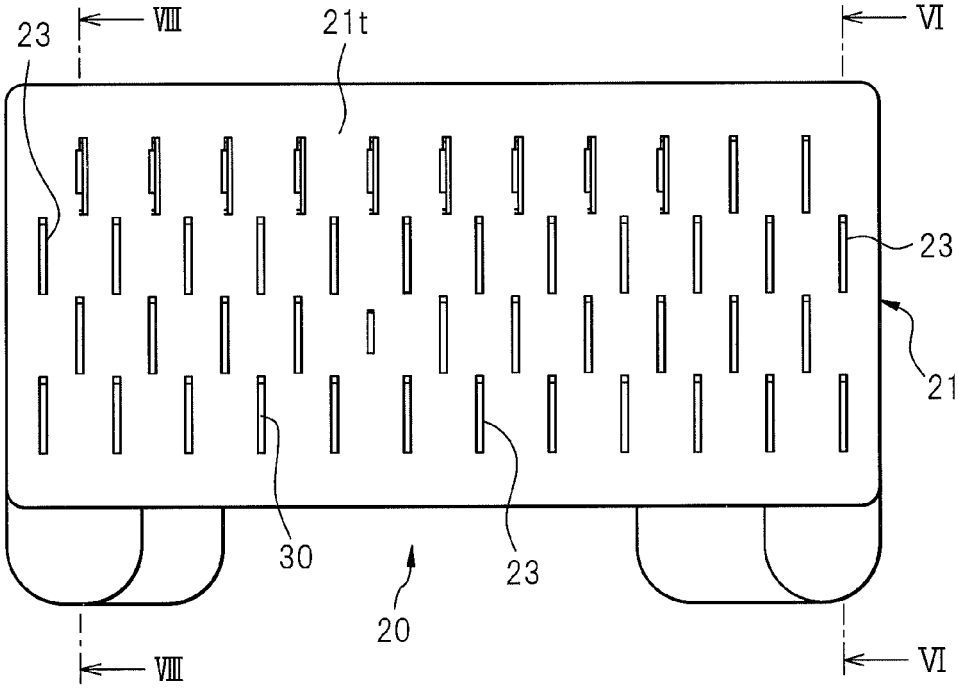
FIG. 3 is a top plan view schematically depicting the connector of FIG. 1.
Figure 4:
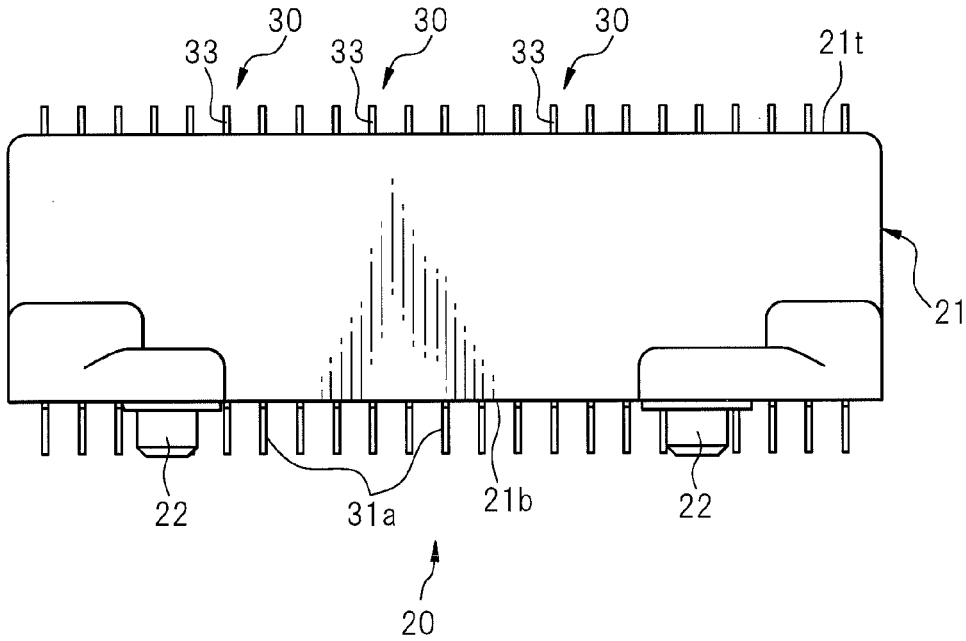
FIG. 4 is a front view schematically depicting the connector of FIG. 1.
Figure 5:
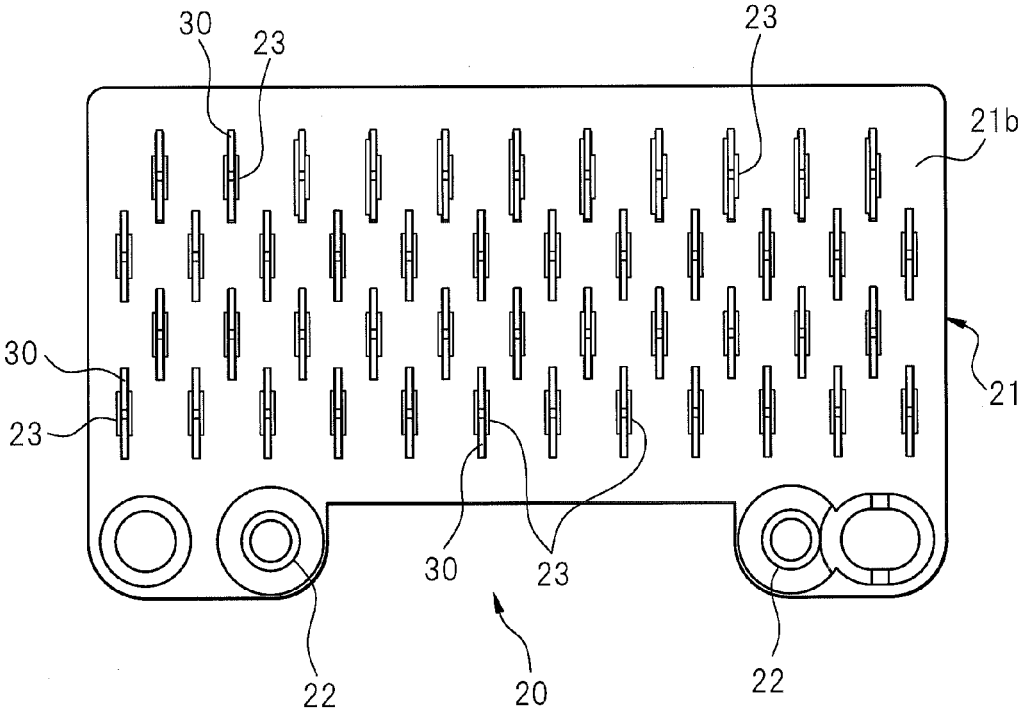
FIG. 5 is a bottom plan view schematically depicting the connector of FIG. 1.

Referring to the drawings, FIGS. 1 and 2 depict a connector 20 according to one embodiment. The connector 20 is used for establishing an electrical connection with a flat contact provided in a flat contact-type device, and includes a housing 21 and a plurality of contact members 30 accommodated in and attached to the housing 21. Although the "flat contact-type device" is not illustrated or explained in detail, one example thereof is, but not limited to, an ink jet printer.

The housing 21 is a substantially box-shaped housing and is molded from an insulating plastic. The housing 21 is provided on the bottom surface 21*b* thereof with a pair of projections 22 for positioning the connector at a predetermined location on, e.g., a not-shown circuit board, etc. As depicted in FIGS. 3-6, the housing 21 is also provided with a plurality of contact member receptacles 23 extending through the housing 21 and opening at the bottom surface 21*b* and the top surface 21*t* thereof. The contact member receptacles 23 are arranged in a staggered manner, and receive the respective contact members 30 at predetermined pitches in vertical and horizontal directions in the plan view. Each contact member receptacle 23 is shaped and dimensioned so as to relatively loosely receive the major portion of each contact member 30, as described below.

Figure 7:
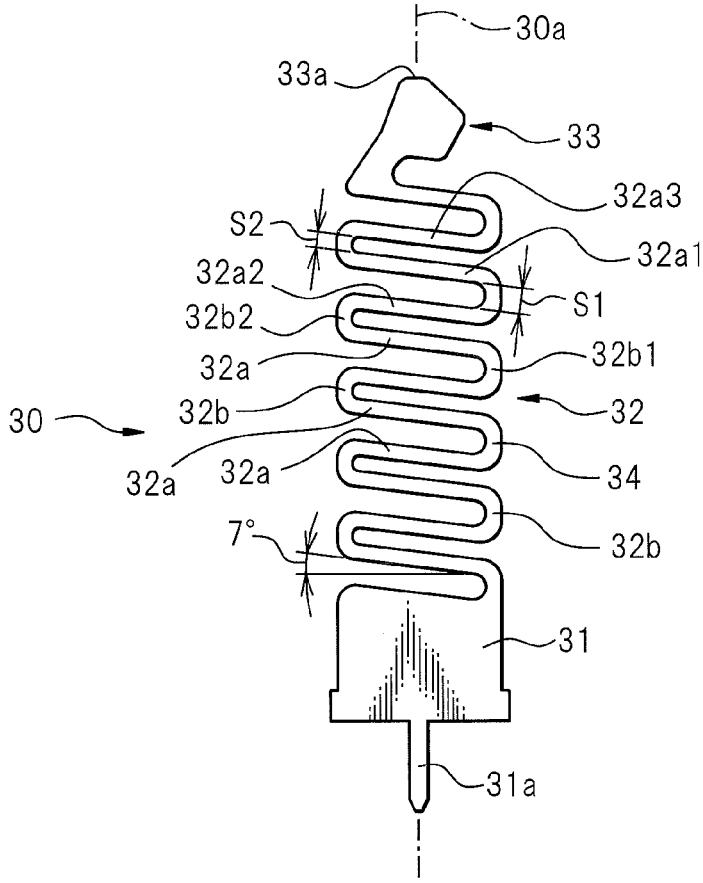
FIG. 7 is a front view schematically depicting a contact member of the connector of FIG. 1.

FIG. 7 depicts the overall profile of a contact member 30. The contact member 30 is formed from a well-known metal sheet having superior electrical conductivity. As the metal sheet having superior electrical conductivity, for example, a phosphor bronze sheet can be used, which is comprised mostly of copper, is superior in strength and spring characteristics, and is suitable as a material for electrical equipment.

As depicted in FIG. 7, the contact member 30 includes a base part 31, a spring part 32 extending (upward, in the drawing) from the base part 31 and having a length variable in an axial direction (i.e., a direction along a longitudinal center axis 30*a*), and a contact part 33 extending (upward, in the drawing) from an axial end of the spring part 32.

Figure 6:
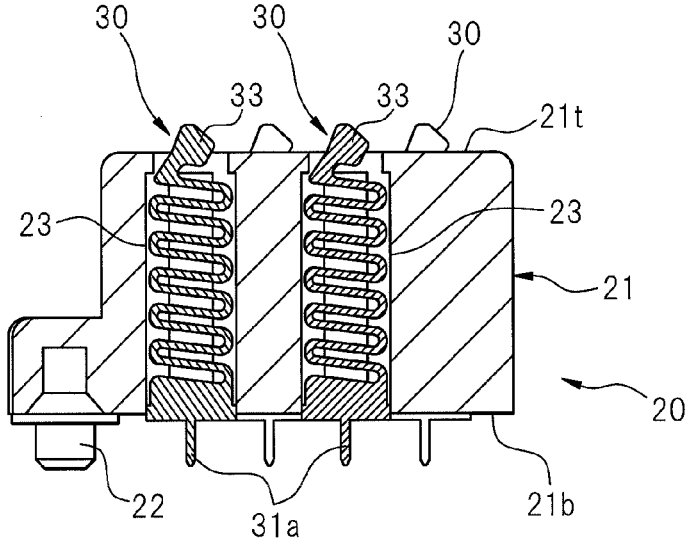
FIG. 6 is a sectional view of the connector, taken along a line VI-VI in FIG. 3.

The base part 31 is fixed to a bottom section of the contact member receptacle 23 adjacent to the bottom surface 21*b* of the housing 21 (FIG. 6). The base part 31 is provided with a terminal pin 31*a* extending outward from the contact member receptacle 23 and project from the bottom surface 21*b* of the housing 21 (FIG. 6). The terminal pin 31*a* is adapted to be electrically connected to a printed circuit part of a circuit board on which the housing 21 is positioned and fixed.

The spring part 32 is loosely received in the contact member receptacle 23 so as to be elastically deformable and movable in the contact member receptacle 23 (FIG. 6). The spring part 32 includes a slanted meandering portion 34 provided with a plurality of major arms (or the predetermined numbers of straight elements) 32*a* spaced from each other in the axial direction and generally slanted with respect to the axial direction or axis 30*a*. The slanted meandering portion 34 is adapted to be elastically deformed so as to narrow a space between the major arms 32*a* by a contact pressure applied from the counterpart flat contact to the contact part 33.

The straight major arms 32*a* have generally identical shapes and dimensions, and are arranged generally parallel to each other when the slanted meandering portion 34 is not elastically deformed. In this undeformed state, each major arm 32*a* is slightly inclined with respect to the axis 30*a* at an angle of, e.g., approximately 7 degrees. Further, in the undeformed state, a space S1 between a first one 32*a*1 of major arms 32*a* and an adjoining second one 32*a*2 of major arms 32*a* is different from (or slightly larger than, in the drawing) a space S2 between the first one 32*a*1 of major arms 32*a* and an adjoining third one 32*a*3 of major arms 32*a* opposite to the second one 32*a*2 of major arms 32*a*. In an exemplary configuration, the space S1 (at the lower side of the first major arm 32*a*1, in the drawing) may be 0.4 mm, and the space S2 (at the upper side of the first major arm 32*a*1, in the drawing) may be 0.3 mm.

The slanted meandering portion 34 is further provided with a plurality of alternately arranged curved connections 32*b*. Each curved connection 32*b* connects corresponding ends of a pair of adjoining major arms 32*a* to each other. In the illustrated configuration, a curvature radius of a first one 32*b*1 (on the right side, in the drawing) of curved connections 32*b* connecting the first major arm 32*a*1 to the adjoining second major arm 32*a*2 is different from (or slightly larger than, in the drawing) a curvature radius of a second one 32*b*2 (on the left side, in the drawing) of curved connections 32*b* connecting the first major arm 32*a*1 to the adjoining third major arms 32*a*3.

In other words, the slanted meandering portion 34 is provided with a plurality (the predetermined number) of slanted U-shaped spring elements connected in series with each other in the axial direction to form a slanted meandering (or successive slanted S-shape) profile, each slanted U-shaped spring element including a pair of parallel major arms 32*a* arranged side-by-side with a predetermined space S1 or S2 defined therebetween, and a curved connection 32*b* connecting corresponding (right or left) ends of the parallel major arms 32*a* to each other, and thereby ensuring a sufficient contact pressure for the contact part 33.

Figure 8:
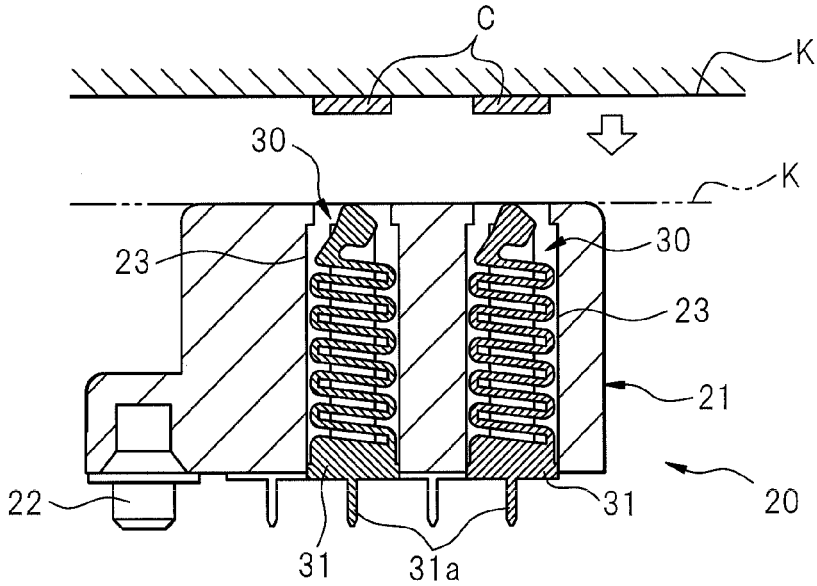
FIG. 8 is a sectional view of the connector, taken along a line VIII-VIII in FIG. 3, for explaining a connecting operation with respect to a counterpart flat contact.

The contact part 33 is connected to the end of the uppermost major arm or straight element 32*a* of the spring part 32, and extends (upward, in the drawing) so as to define an elevation angle with respect to the uppermost major arm 32*a* considerably larger than the aforementioned inclined angle of the major arm 32*a*. The contact part 33 extends outward from the contact member receptacle 23 and projects from a top surface 21*t* of the housing 21, when the contact member 30 is in the state of a natural or initial length (i.e., when the spring part 32 is not elastically deformed or shortened). When the spring part 32 is elastically shortened due to the contact pressure, the contact part 33 is loosely received in the contact member receptacle 23 so as to be movable in the contact member receptacle 23 (FIG. 8).

The contact part 33 is adapted to be pushed against and electrically connected to a counterpart flat contact of a flat contact-type device, and slide on the counterpart flat contact under a contact pressure so as to wipe the surface of the flat contact. The contact part 33 is also adapted to be displaced so as to slide on the counterpart flat contact by an elastic deformation of the slanted meandering portion 34 of the spring part 32 as described later.

The contact part 33 is provided with a wiping edge 33*a* adapted to slide on the counterpart flat contact under the contact pressure. The wiping edge 33*a* is shaped as a straight edge having a short length for ensuring a linear contact with the counterpart flat contact in a wiping direction.

The connector 20 having the above configuration operates to establish an electrical connection with a flat contact provided in a flat contact-type device, as follows. Note that, in the following explanation, terms representing the directionality of components (e.g., upper, lower, right, left, etc.) are used merely for easily understanding the illustrated configuration, and do not provide any limitations of the inventive structure of the connector 20.

In an inoperative state (i.e., a state where the connector 20 is not connected to the counterpart flat contact), the contact member 30 is received in the contact member receptacle 23 of the housing 21 while maintaining a natural or initial entire length of the contact member 30, in a condition free of stress due to external force. In this state, as depicted in FIGS. 1, 2, 4 and 6, the contact part 33 projects outward from the contact member receptacle 23 and the wiping edge 33*a* is exposed above the top surface 21*t* of the housing 21.

Upon starting in the electrical connection between the connector 20 and the flat contact-type device, the counterpart flat contact C provided on the surface K of the flat contact-type device is pushed against the wiping edge 33*a* of the contact part 33 of the contact member 30 (FIG. 8). Then, the flat contact C is moved relative to the housing 21 in the axial direction of the contact member 30 while pushing the contact part 33, and the surface K is finally abutted against the top surface 21*t* of the housing 21 as depicted by a two-dot chain line. In this state, a proper electrical connection under a predetermined contact pressure is achieved between the wiping edge 33*a* of the contact part 33 of the contact member 30 and the counterpart flat contact C.

Figure 9:
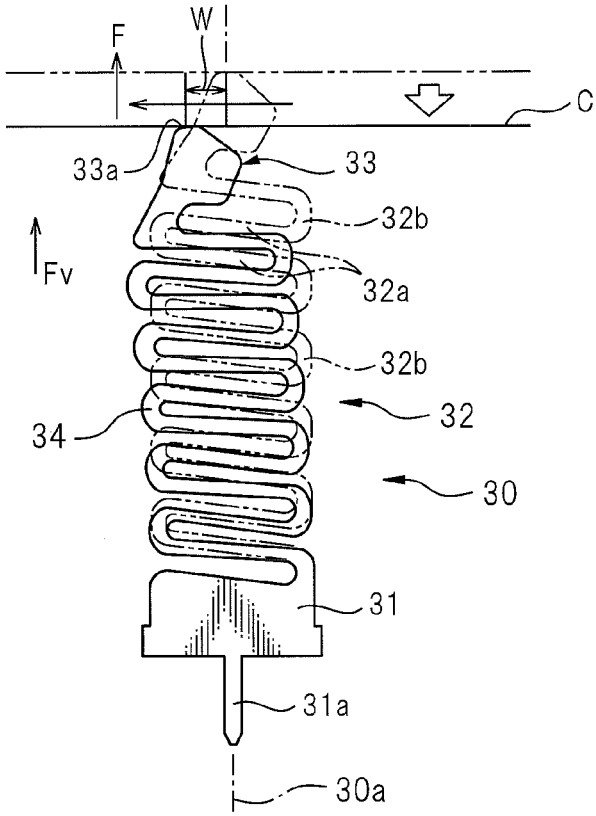
FIG. 9 is a schematic illustration depicting a displacement behavior of the contact member of FIG. 8.
Figure 10A:
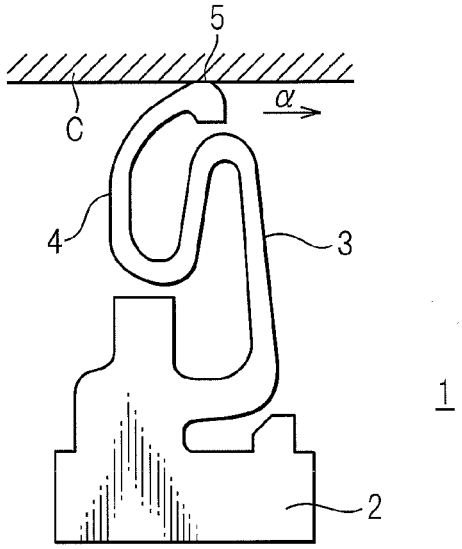
FIG.10A PRIOR ART
FIGS. 10A-10C are schematic illustrations depicting the configuration of a contact member of a conventional electrical connector.
Figure 10B:
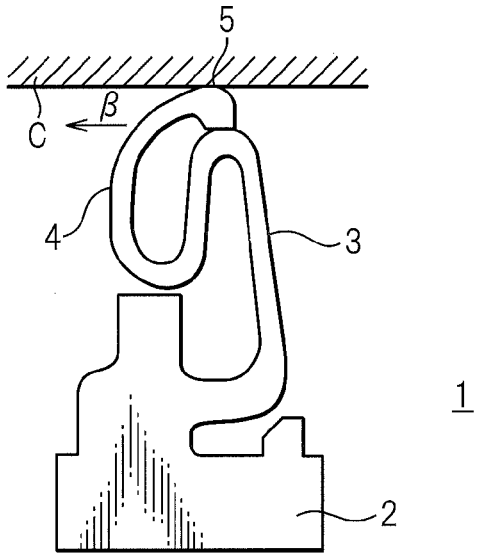
FIG.10B PRIOR ART
Figure 10C:
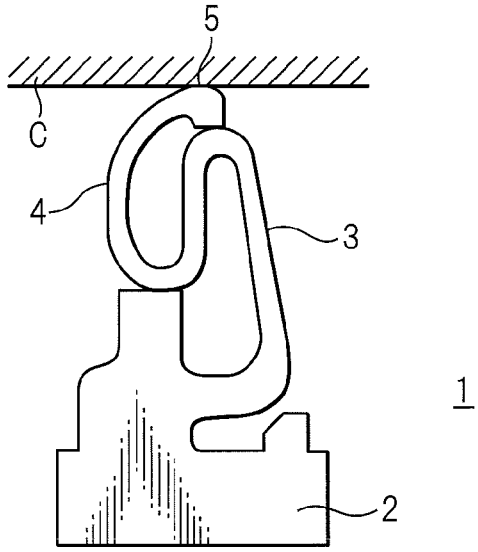
FIG.10C PRIOR ART

During a process for achieving the proper electrical connection under the predetermined contact pressure between the wiping edge 33*a* of the contact member 30 and the counterpart flat contact C, the wiping edge 33*a* is subjected to a reaction force F generated by the major arms 32*a* and the curved connections 32*b*1, 32*b*2 of the spring part 32 (FIG. 9).

More specifically, when the contact member 30 is pushed down in the axial direction, the major arms 32*a* and the curved connections 32*b* of the spring part 32 are elastically deformed so as to narrow the space between the major arms 32*a* in the axial direction, so that the spring part 32 is elastically deformed or shortened in the axial direction. At this time, the spring part 32 made of phosphor bronze having a superior flexibility generates a repelling force Fv in the axial direction. Also, the major arms 32*a* slightly inclined at the angle of, e.g., 7 degrees respectively generate a rotational moment about the left and right curved connections 32*b*1, 32*b*2.

In this connection, since the space S1 (e.g., 0.4 mm) at the lower side of the first major arm 32*a*1 is slightly larger than the space S2 (e.g., 0.3 mm) at the upper side of the first major arm 32*a*1, the amount of buckling or displacement of the left-side curved connection 32*b*2, forming the upper-side space S2 and having a smaller curvature radius, is somewhat larger than that of the right-side curved connection 32*b*1, forming the lower-side space S1 and having a larger curvature radius. As a result, the spring part 32 is generally deformed so as to be displaced leftward with respect to the center axis 30*a*, as depicted in FIG. 9.

Accompanying the aforementioned motion of the spring part 32, the contact part 33 is retracted in the axial direction into the contact member receptacle 23 and simultaneously is displaced in a direction generally perpendicular to the axial direction. Due to the displacement of the contact part 33 in the direction perpendicular to the axial direction, the straight wiping edge 33*a* of the contact part 33 slides on the counterpart flat contact C by a predetermined distance (e.g., about 0.3 mm) while maintaining a contact pressure due to the reaction force F, whereby the oxide layer, dust, etc., on the surface of the flat contact C and/or on the wiping edge 33*a* are wiped off due to a wiping effect of the wiping edge 33*a*. Consequently, a stable electrical connection can be ensured without increasing a contact resistance.

As explained above, during the operation for establishing the electrical connection between the connector 20 and the counterpart flat contact C, the flat contact C is pushed down to a limit position where the device surface K carrying the flat contact C is abutted against the top surface 21*t* of the housing 21, so that the repelling force Fv generated by the straight major arms 32*a* and the curved connections 32*b* of the spring part 32 gradually increases to a maximum value obtained at the limit position. Simultaneously, the wiping edge 33*a* of the contact part 33 slides on the flat contact C, and is displaced by a maximum distance W with respect to the flat contact C, so that a wiping effect is obtained (FIG. 9). Thus, when the flat contact C reaches the limit position where the device surface K is abutted against the top surface 21*t* of the housing 21, a good electrical connection is always achieved.

Figure 11A:
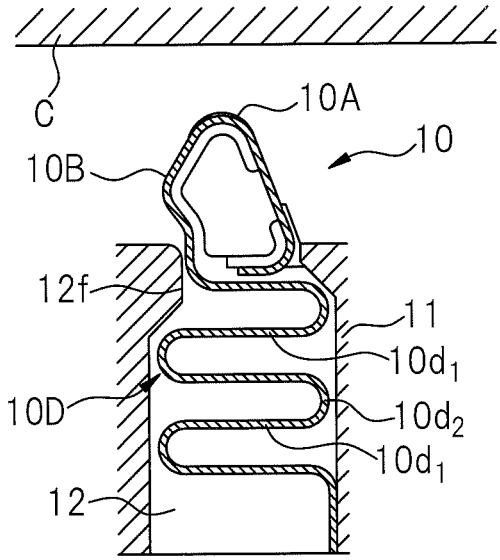
FIG.11A PRIOR ART
FIGS. 11A-11B are schematic illustrations depicting the configuration of a contact member of another conventional electrical connector.
Figure 11B:
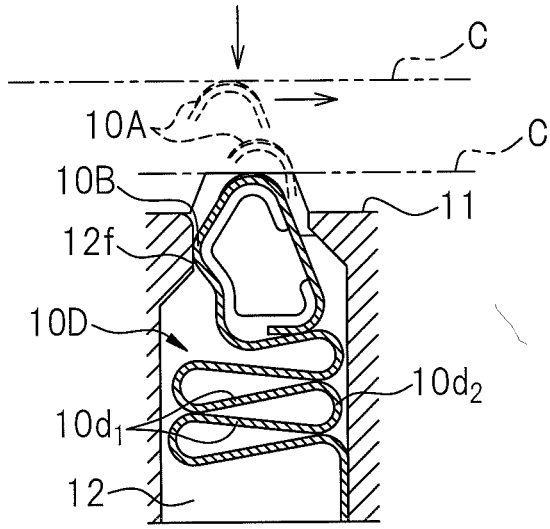
FIG.11B PRIOR ART

Therefore, according to the connector 20 of the illustrated embodiment, a good wiping effect and a sufficient contact pressure can be ensured. Further, since the major arms 32*a* and the curved connections 32*b* of the spring part 32 generate a rotational moment due to the pushing force applied to the contact part 33 in the axial direction, the contact member 30 can exert the wiping effect by itself, i.e., without using any separate member, such as the side wall 12*f* of the contact member receptacle 12 (FIG. 11B).

Thus, the connector 20 includes the contact member 30 having a simple configuration capable of ensuring a wiping effect, in particular, a wiping distance, and capable of ensuring and easily maintaining a desired contact pressure.

While the invention has been described with reference to specific embodiments, it will be understood by those skilled in the art that various changes and modifications may be made thereto without departing from the scope of the following claims. For example, the shapes and dimensions of the major arms 32*a* and the curved connections 32*b* (32*b*1, 32*b*2) may be suitably changed in accordance with the various configuration of the counterpart flat contact-type device.

The invention claimed is:

1. A connector comprising:

a contact member; and a housing, the contact member including:

a spring part having a length variable in an axial direction, and a contact part extending from an axial end of the spring part and adapted to be pushed against and electrically connected with a counterpart flat contact, wherein the spring part including a slanted meandering portion provided with a plurality of major arms spaced from each other in the axial direction, the major arms being slanted with respect to the axial direction and arranged parallel to each other when the slanted meandering portion is not elastically deformed, the slanted meandering portion adapted to be elastically deformed so as to narrow a space between the major arms by a contact pressure applied from the counterpart flat contact to the contact part, and wherein the contact part adapted to be displaced so as to slide on the counterpart flat contact by an elastic deformation of the slanted meandering portion.

2. The connector of claim 1, wherein a space between a first major arm and an adjoining second major arm is different from a space between the first major arm and an adjoining third major arm opposite to the second major arm.

3. The connector of claim 1, wherein the slanted meandering portion is provided with a plurality of alternately arranged curved connections, each curved connection connecting corresponding ends of a pair of adjoining major arms to each other wherein a curvature radius of a first curved connection connecting the first major arm to the adjoining second major arm is different from a curvature radius of a second curved connection connecting the first major arm to the adjoining third major arm, and wherein the contact part is adapted to be displaced in the direction perpendicular to the axial direction by the elastic deformation of the major arms and the curved connections, in which a displacement of a first curved connection is different from a displacement of a second curved connection.

4. The connector of claim 1, wherein the contact part is provided with a straight wiping edge adapted to slide on the counterpart flat contact under the contact pressure.

5. A connector comprising:

a contact member; and a housing, wherein the contact member including:

a spring part having a length variable in an axial direction, in which the spring including plural arms spaced apart from each other and curved portions each of which adjoins ends of neighboring arms, where the arms are slanted in a same direction with respect to the axial direction and arranged parallel to each other, a contact part extending from an axial end of the spring part and adapted to be pushed against and electrically connected to a counterpart flat contact, wherein the spring is adapted to be elastically deformed by a contact pressure applied from the counterpart flat contact to the contact part, and the contact part is adapted to be displaced on the counterpart flat contact by an elastic deformation of the spring.

6. The connector of claim 5, wherein a curvature radius of a curved portion adjoining first ends of the arms is different from a curvature radius of a curved portion adjoining second ends of the arms.

* * * * *